United States Patent [19]

Wilcke

[11] Patent Number: 4,627,476

[45] Date of Patent: Dec. 9, 1986

[54] TONER REFILL CONTAINER

[75] Inventor: Gerhard Wilcke, Berlin, Fed. Rep. of Germany

[73] Assignee: Berolina International Marketing Strategie GmbH, Berlin, Fed. Rep. of Germany

[21] Appl. No.: 642,677

[22] PCT Filed: Dec. 21, 1983

[86] PCT No.: PCT/DE83/00216

§ 371 Date: Aug. 10, 1984

§ 102(e) Date: Aug. 10, 1984

[30] Foreign Application Priority Data

Dec. 21, 1982 [DE] Fed. Rep. of Germany ..... 3247965

[51] Int. Cl.[4] ..... B65D 47/10; G03G 15/08

[52] U.S. Cl. ..... 141/364; 141/392; 215/253; 222/325; 222/541; 222/DIG. 1

[58] Field of Search ..... 222/325, 541, 542, DIG. 1; 141/350, 326, 154, 89, 98, 392, 363–366; 206/270; 215/295, 232, 250, 253–256, 270, 292, 354; 221/302

[56] References Cited

U.S. PATENT DOCUMENTS

| | | | |
|---|---|---|---|
| 2,213,932 | 9/1940 | Rehfeld | 215/250 X |
| 2,701,078 | 2/1955 | Bowman | 141/366 X |
| 3,032,225 | 5/1962 | Harding | 215/250 X |
| 3,369,579 | 2/1968 | Hollowell | 141/364 X |
| 3,415,405 | 12/1968 | Rausing | 215/253 |
| 3,785,519 | 1/1974 | Huh | 215/305 X |
| 3,915,208 | 10/1975 | Anderson | 222/DIG. 1 X |
| 3,999,654 | 12/1976 | Pollack | 222/542 X |
| 4,060,105 | 11/1977 | Feldeisen | 222/DIG. 1 X |
| 4,062,385 | 12/1977 | Katusha et al. | 222/325 X |
| 4,573,614 | 3/1986 | Ozawa | 222/561 X |

FOREIGN PATENT DOCUMENTS

| | | |
|---|---|---|
| 1111994 | 7/1961 | Fed. Rep. of Germany . |
| 1588967 | 4/1970 | France . |

*Primary Examiner*—Joseph J. Rolla
*Assistant Examiner*—Kevin P. Shaver
*Attorney, Agent, or Firm*—Mark P. Stone; F. Eugene Davis, IV

[57] ABSTRACT

To facilitate the refilling of a fluid toner into a toner container of a printing of copying device, a toner refill container (16) is used which has a nozzle (20), whose opening is sealed by a foil (5), which can be removed from the nozzle edge (7) by a tear-open or tear-off cord (6) after a coupling ring (17) of the toner refill container (16) has been inserted into the filler neck (22) of a toner container (23). Moreover, the tear-open or tear-off cord (6) is led from the inside of the toner container (23) through a guide channel (18) to the outside.

1 Claim, 3 Drawing Figures

TONER REFILL CONTAINER

BACKGROUND OF THE INVENTION

The invention relates to a toner refill container for copying and printing devices with a nozzle, which can be inserted into a filler neck of the respective device, and which has a seal.

A refill container of the above type is known in which the known principle of refill cartridges for other purposes, that is, for example, of refill cartridges for fountain pens, is applied, according to which a membrane on the refill cartridge is destroyed or moved out of its sealed position by a pin on the device. The disadvantage of such a refill container lies in the fact that either the toner container on the device has to be reset or, on the other hand, it is essential to use a special intermediate piece having the pin used to open the refill container.

It is the object of the invention to create a particularly simple toner refill container, which can be inserted without an intermediate piece directly into the filler neck of known copying and printing devices, and which nevertheless can be easily handled.

SUMMARY OF THE INVENTION

According to the invention, this object is achieved when the seal comprises a foil which can be torn open or torn off, which is connected to at least one tear-open or tear-off cord, which at the nozzle protruding into the filler neck is led along the nozzle and out of the filler neck, and which can be operated outside the filler neck.

The toner refill container according to the invention offers the advantage that it can be closed by a particularly economic method, namely heat sealing, after filling. It is simple to use, and it is unnecessary to use special filler necks or intermediate elements. Compared in particular with solutions in which intermediate pieces are used, the contamination risk to the operating person is considerably reduced.

BRIEF DESCRIPTION OF THE DRAWINGS

The invention is explained in greater detail below, with reference to the attached drawing in which.

DESCRIPTION OF THE PREFERRED EMBODIMENTS

Figure 1:
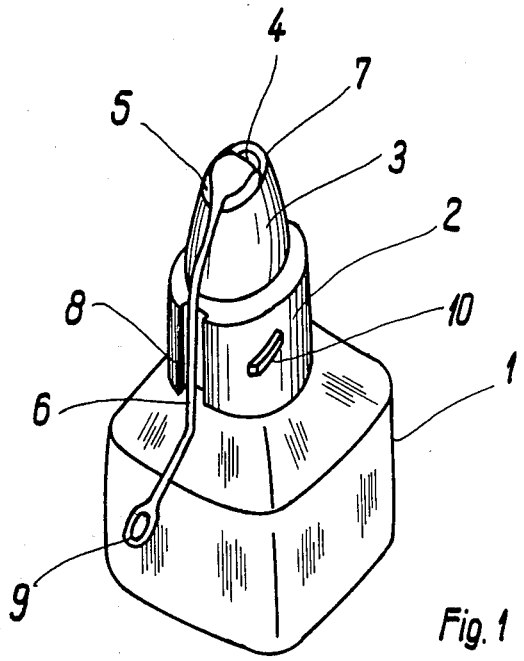
FIG. 1: shows a perspective view of a first toner refill container.

FIG. 1 shows a toner refill container 1, which has a coupling ring 2 and adjoining here a nozzle 3. In the case of FIG. 1, the opening 4 of the nozzle 3 is only partially covered by a foil 5, which is connected to a tear-open or tear-off cord 6, which enables the foil 5 to be pulled off from the nozzle edge 7 of the nozzle 3. The tear-open or tear-off cord 6 passes a guide channel 8 in the area of the coupling ring. A pulling eyelet 9 is arranged at the end of the tear-open or tear-off cord. 10 is the coupling land, which enables the coupling ring to have a bayonet catch connection with an appropriately designed filler neck of a printing or copying device.

Figure 2:
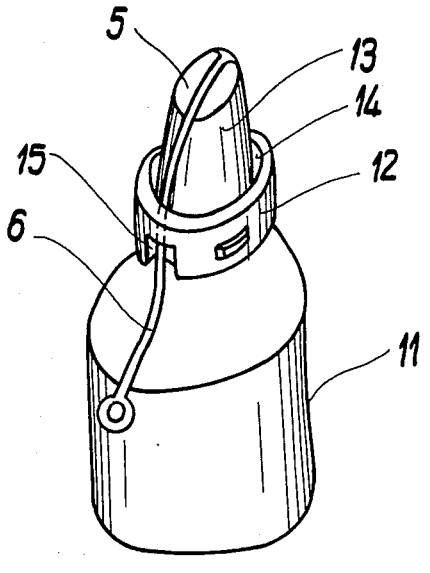
FIG. 2: shows a perspective view of a second toner refill container.

With the toner refill container 11 according to FIG. 2, a coupling ring 12 encloses, collar-like, a nozzle 13. The tear-open or tear-off cord, here also designated 6, first passes a gap 14 between the coupling ring 12 and the nozzle 13, and then passes through a guide channel 15 to the outside.

Figure 3:
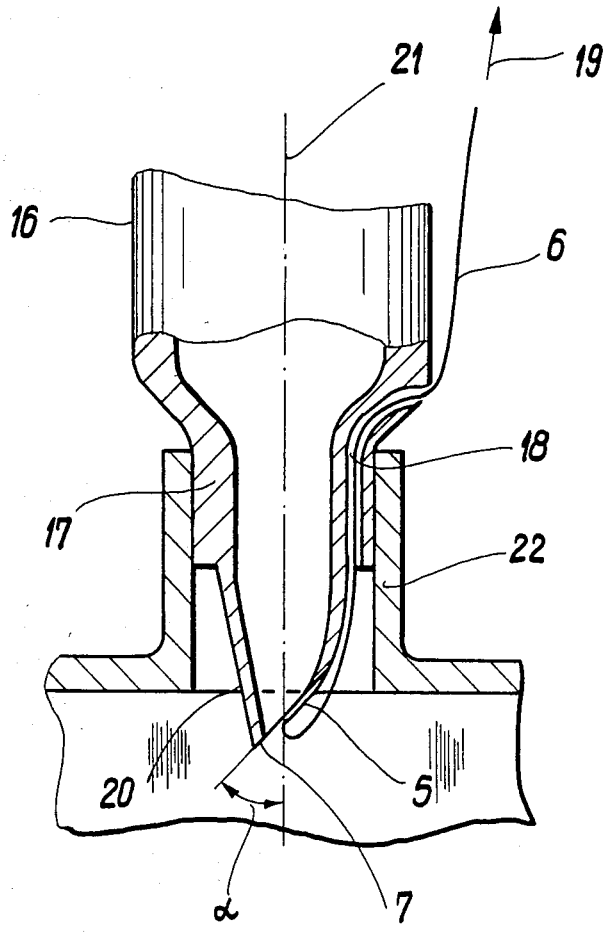
FIG. 3: shows a section through a nozzle of a toner refill container, the nozzle being inserted through a filler neck of a copying or printing device.

FIG. 3 shows a toner refill container 16 with a guide channel 18 extending through a coupling ring 17 and a part of the wall adjoining this coupling ring. It can be seen that, by operating the tear-open or tear-off cord 6 in the direction of the arrow 19, the foil 5 can be pulled off from the edge 7 of the nozzle 20 without difficulty. To facilitate the pulling-off, the nozzle edge 7 occupies an angle $\alpha$ relative to the longitudinal axis of the toner refill container 16. Preferably, the slope of the nozzle edge is at an angle of at least 45° to the longitudinal axis of the nozzle. It is possible that the nozzle edge 7 can be formed by parts of a curved surface instead of by parts of a sloping plane. The ease with which the foil 5 is pulled off can be influenced by the nozzle edge being suitably shaped.

As can be seen from FIG. 3, the coupling ring 17 is inserted directly into the filler neck 22 of the toner container 23 of a printing device.

I claim:

1. A toner refill container for a copying or printing device which has a toner reservoir including a filler neck defining an inlet into said reservoir, said toner refill container comprising a nozzle for insertion into said inlet port and a coupling ring, said coupling ring adapted to be secured to said filler neck when said nozzle is inserted into said inlet port, said coupling ring at least partially surrounding said nozzle, said coupling ring defining a guide channel therein, a foil sealing an opening of said nozzle, a cord attached to said foil, said cord being received in said guide channel in said coupling ring and extending from said filler neck so that said foil may be removed from said nozzle by pulling said cord from outside of said filler neck, a nozzle edge bordering the opening of the nozzle having a slope to the longitudinal axis of the nozzle, and said cord being attached to the lower edge of said foil and extending thereacross when the container is inverted in said filler neck.

* * * * *